US008347532B1

(12) United States Patent
Johnson

(10) Patent No.: US 8,347,532 B1
(45) Date of Patent: Jan. 8, 2013

(54) BRANDABLE DRIP-STOP COLLAR FOR BOTTLES

(76) Inventor: K. Christian Johnson, Irvine, CA (US)

( * ) Notice: Subject to any disclaimer, the term of this patent is extended or adjusted under 35 U.S.C. 154(b) by 527 days.

(21) Appl. No.: 12/561,228

(22) Filed: Sep. 16, 2009

Related U.S. Application Data

(60) Provisional application No. 61/192,105, filed on Sep. 16, 2008.

(51) Int. Cl.
*G09F 3/04* (2006.01)

(52) U.S. Cl. ..... 40/310; 229/89

(58) Field of Classification Search ..... 229/89; 40/311, 310; 428/5
See application file for complete search history.

(56) References Cited

U.S. PATENT DOCUMENTS

| | | | | |
|---|---|---|---|---|
| 1,683,176 | A | 9/1928 | Faulhaber | |
| 2,048,405 | A * | 7/1936 | Olsen | 40/310 |
| 2,127,342 | A * | 8/1938 | Neher | 40/310 |
| 2,199,037 | A * | 4/1940 | Borden | 40/310 |
| 3,063,590 | A | 11/1962 | Hopkins | |
| 4,895,741 | A * | 1/1990 | Coffman | 428/5 |
| D333,639 | S * | 3/1993 | Matan | D11/184 |
| 5,240,750 | A * | 8/1993 | Cheng | 428/5 |
| 6,325,247 | B1 | 12/2001 | Iggulden | |
| D563,784 | S | 3/2008 | Swartz et al. | |
| 2005/0199579 | A1 | 9/2005 | Novak | |
| 2010/0187256 | A1 * | 7/2010 | Draisma | 222/108 |

* cited by examiner

*Primary Examiner* — Tri Mai
(74) *Attorney, Agent, or Firm* — Jerry Turner Sewell

(57) ABSTRACT

A removable collar of flexible, absorbent material fits over the neck of a bottle. The collar absorbs liquids that drip from the bottle. The material is initially shaped as an isosceles trapezoid. The collar is formed into a truncated, generally conical shape by overlapping two opposing vertices at each end of the shorter parallel edge of the trapezoid to form a point at a lower end of the collar to produce the appearance of a "cravat." A vertex at the longer edge of the trapezoid overlaps a portion of the shorter edge of the trapezoid and is secured to the overlapped portion at a single point. The generally conical collar has an upper opening that expands to allow the collar to pass around the enlarged flange near the top of the bottle. The upper opening snaps back to an original size to fit against the neck of the bottle.

14 Claims, 5 Drawing Sheets

BRANDABLE DRIP-STOP COLLAR FOR BOTTLES

RELATED APPLICATIONS

This application claims the benefit of priority under 35 USC 119(e) to U.S. Provisional Patent Application No. 61/192,105, filed on Sep. 16, 2008, which is incorporated in its entirety by reference herein.

BACKGROUND OF THE INVENTION

1. Field of the Invention

The present invention is in the field of protective collars for bottles, and, more particularly, is in the field of decorative drip-stop collars that may be branded and may also serve as gift cards to accompany a bottle.

2. Description of the Related Art

Wine and other beverages are often purchased in bottles to be presented as gifts. Because of the shapes of the bottles, it is difficult to wrap the bottles and to attach gift cards. The wines or other beverages in wine bottles often have propensities to stain tablecloths and clothing because of residual amounts of liquids remaining at the tops of the bottles after the beverages are poured into glasses when served.

Various attempts have been made to avoid or at least reduce the propensity for dripping. For example, servers at restaurants and at parties often carry a napkin or small towel to wipe excess liquid from the tops of the bottles after each serving. To avoid this inconvenience, products have been proposed to attach to the bottles. For example, strips of absorbent material have been wrapped around necks of bottles and held in place using string, wire, or adhesive. Tubular sleeves produced from elastic fabric have been placed around the necks of bottles. One proposed solution uses an encapsulated band of absorbent material adhered directly to the necks of bottles.

The previously proposed solutions have issues that substantially reduce their effectiveness in the mass retail market. For example, many of the previously proposed solutions cannot be produced at a cost-effective price so that the products can be used as a disposable point of sale (POS) piece by retailers. In particular, retailers are not interested in using items that result in an increase of the retail price of a bottle of wine or liquor.

Generally, the devices in accordance with previously proposed solutions are not "pre-assembled" because the devices are not designed to fit over the many different sizes and styles of flanges that are found at the tops of the many varieties of bottles used by the wine and liquor industries. The delivery of the devices to the retailers in an unassembled condition presents problems for retailers. For example, a person in the retail store must assemble and/or affix the device to the bottle at or prior to the point of sale. This assembly time may reduce the sales volume or may result in the devices not being used when the sales person is in a hurry. Furthermore, the devices may be assembled incorrectly and/or inconsistently from bottle-to-bottle, which would result in a non-uniform presentation to the consumer.

Many of the devices in accordance with previously proposed solutions are not effective in the mass-retail market because the devices are generally attached or affixed to bottles in a manner such that the devices cannot be easily removed without being damaged and therefore the devices cannot be re-used. One potential problem for retailers is that if a device were printed or marked to indicate a certain brand or type of wine or liquor and was then affixed to the wrong bottle, the device could not be easily removed to place the device on the correct bottle and to place the correct device on the improperly marked bottle. The value of a device that cannot be transferred from one bottle to another is less than for a device that can be used on multiple bottles.

SUMMARY OF THE INVENTION

Embodiments of drip-stop collars in accordance with embodiments of the present invention represent an improvement over previously proposed devices because the embodiments avoid the above-described deficiencies. Furthermore, the embodiments provide additional advantages in being usable as gift cards that can be personalized as part of the presentation of a fine bottle of wine or liquor as a gift.

In accordance with an embodiment disclosed herein a drip-stop collar has a lower opening that fits over the outwardly expanding neck of a wine or liquor bottle. The periphery of the lower opening rests on the neck of the bottle. An upper opening of the drip-stop collar expands sufficiently to allow the drip-stop collar to be moved past the flange (ridge) immediately below the mouth of the bottle. The upper opening then returns to an original size so that the drip-stop collar is precluded from moving past the flange without applying force. The opening is able to expand over the top of a bottle without using expensive elastic materials by creating a single flex or pivot point at a lower portion of the collar to maintain the shape of the collar. In particular, an upper left corner on the inside of the original flat shape of the collar is secured to a designated location on the outside of the collar when curled to form the assembled shape. The flex point is formed by using adhesive, by using a folding adhesive tab or by inserting a locking tab into to a tab slot. The finished collar resembles an upside-down truncated conical funnel that has the smaller opening located at the top. The single flex point allows the collar to expand to accommodate different sizes of bottle flanges and also allows the collar to adjust to fit snugly around different diameters and designs of bottle necks.

The drip-stop collar disclosed herein can be provided to retailers either in a pre-assembled form or in a flat form so that the collar can be assembled later. Because of the shape of the collar, the collar is readily assembled to form a consistent shape. When the collar is assembled, the collar can be slipped quickly and easily over the top of a bottle and slid down the neck until the collar rests on the shoulder or slope of the bottle.

The drip-stop collar disclosed herein is easily removed from a bottle and moved to another bottle, thereby increasing the value of the collar to retailers and to consumers. Unlike previous devices, the drip-stop collar disclosed herein can be removed easily from an empty bottle by a consumer and used on another bottle. The removed drip-stop collar can also be kept as a memento of the occasion for which the original bottle was presented or opened (e.g., a birthday, anniversary, etc.). The drip-stop collar may also be labeled or annotated with information such as the date, the restaurant, the server, or the like, to further commemorate a special occasion.

In certain embodiments, the drip-stop collar may be advantageously configured to include a removable piece of the same or a different material that can be used as a coupon, recipe, gift card, comment card, or the like.

An embodiment in accordance with aspects of the present invention is a drip-collar for a bottle. The drip-collar comprises a sheet of flexible, absorbent material having an isosceles trapezoidal shape. The trapezoidal shape comprises a longer edge and a shorter edge. The longer edge and the shorter edge are mutually parallel when the trapezoidal shape is flat. The trapezoidal shape further comprises a first sloped edge and a second sloped edge between the longer edge and the shorter edge. The first sloped edge forms a first vertex with the longer edge. The second sloped edge forms a second vertex with the longer edge. The first vertex and the second vertex have substantially equal acute angles. The first sloped edge forms a third vertex with the shorter edge. The second sloped edge forms a fourth vertex with the shorter edge. The third vertex and the fourth vertex have substantially equal obtuse angles. A fastener is positioned to secure the first vertex to a location on the shorter edge to form the sheet into a truncated, generally conical form with the third vertex positioned over the fourth vertex, with the first sloped edge aligned with a first portion of the shorter edge proximate to the fourth vertex, and with the second sloped edge aligned with a second portion of the shorter edge proximate to the third vertex. In certain embodiments, the fastener comprises an adhesive on an inner surface of the first vertex that secures the inner surface of the first vertex to an outer surface of the sheet proximate to the shorter edge. In alternative embodiments, the fastener comprises a tab that extends from the first sloped edge proximate to the first vertex. The tab is foldable about the shorter edge to position an inner surface of the tab against an inner surface of the sheet proximate to the shorter edge. The inner surface of the tab has an adhesive that secures the inner surface of the tab to the inner surface of the sheet proximate to the shorter edge. In a further alternative embodiment, the fastener comprises a tab that extends from the longer edge proximate to the first vertex. A slot is formed through the sheet at a location proximate to the position of the first vertex when the sheet is formed in the conical shape. The tab is positionable through the slot to retain the sheet in the conical shape. Preferably, the drip-collar has the appearance of a cravat when the drip-collar is positioned over the neck of a bottle with a lower perimeter of the drip-collar resting on a shoulder between the neck and a main body of the bottle. In preferred embodiments, the truncated, generally conical shape of the drip-collar comprises a lower peripheral opening formed by the shorter edge. The lower peripheral opening is sized to allow the drip-collar to rest on the shoulder of a bottle. An upper opening is formed by overlapping portions of the longer edge. The upper opening is sized to fit the neck of a bottle and is sized to be less than the size of a flange around the neck of the bottle. The upper opening is spaced a sufficient distance away from the fastener to enable the upper opening to flex with respect to the fastener and temporarily expand to allow the flange to pass through the upper opening.

Another embodiment in accordance with aspects of the present invention is a method of forming a decorative drip-collar for a bottle having a main body, a neck with an upper opening, a flange on the neck below the opening and a shoulder forming a transition between the main body and the neck. The method provides a flat sheet of flexible material having an outer surface and an inner surface. The outer surface is shaped as an isosceles trapezoid having longer and shorter edges that are mutually parallel and having first and second sloped edges. The first sloped edge forms a first vertex at an acute angle with the longer edge. The second sloped edge forms a second vertex at the acute angle with the longer edge. The first sloped edge forms a third vertex at an obtuse angle with the shorter edge. The second sloped edge forms a fourth vertex at the obtuse angle with the shorter edge. The method includes curling the sheet of flexible material into a truncated conical shape to position the third vertex over the second vertex, to position the first sloped edge over and in alignment with a portion of the shorter edge proximate to the fourth vertex, and to position a portion of the shorter edge proximate to the third vertex over and in alignment with the second sloped edge. The method further includes securing a first portion of the sheet of flexible material proximate to the first vertex to an underlying second portion of the sheet proximate to the lower edge to retain the sheet in the truncated conical shape. In certain embodiments of the method, the first portion of the sheet of flexible material is secured to the second portion of the sheet using an adhesive applied between the inner surface of the first portion of the sheet and the outer surface of the second portion of the sheet. In alternative embodiments of the method, the first portion of the sheet of flexible material is secured to the second portion of the sheet using an adhesive applied to a tab extending from the first sloped edge. The tab is folded about the lower edge to secure the tab to the inner surface of the sheet proximate to the first sloped edge. In a further alternative embodiment of the method, the first portion of the sheet of flexible material is secured to the second portion of the sheet using a tab that extends from the longer edge. The tab is sized to engage a slot formed in the sheet at a location adjacent to the position of the slot when the sheet is formed into the truncated conical shape with the third and fourth vertices mutually aligned.

Another embodiment in accordance with aspects of the present invention is a method of reducing dripping of liquid from a bottle having a main body, a neck with an upper opening, a flange on the neck below the opening and a shoulder forming a transition between the main body and the neck. The method comprises forming a drip-collar having a truncated, generally conical shape from a sheet of flexible, absorbent material having an initial isosceles trapezoidal shape. The truncated, generally conical shape has a lower opening defined by a lower peripheral edge and has an upper opening formed by an upper peripheral edge. The upper opening has a static size smaller than the flange on the neck of the bottle. The method further comprises securing the sheet of flexible, absorbent material into the truncated, generally conical shape at a single location along the lower peripheral edge of the generally conical shape. The drip-collar is positioned over the neck of the bottle. The upper opening is sufficiently displaced from the single location along the lower peripheral edge to enable the upper opening to temporarily expand from the static size to a size sufficiently large to allow the flange of the bottle to pass through the upper opening. The upper opening returns to a size that causes the upper opening to fit closely around the neck of the bottle below the flange. In accordance with certain embodiments of the method, a portion of the lower peripheral edge of the truncated, generally conical shape is formed by overlapping vertices of the trapezoidal-shaped material and has the appearance of a cravat.

BRIEF DESCRIPTION OF THE DRAWINGS

Embodiments in accordance with aspects of the present invention are described below in connection with the attached drawings in which:

FIG. 1 illustrates a front elevational view of a drip-stop collar 10 positioned on the neck 22 of a bottle 20, such as, for example, a bottle of wine, a bottle of liquor, or the like;

DETAILED DESCRIPTION OF PREFERRED EMBODIMENTS

The drip-stop collar is disclosed herein with respect to exemplary embodiments. The embodiments are disclosed for illustration of the drip-stop collar and are not limiting except as defined in the appended claims.

Figure 1:
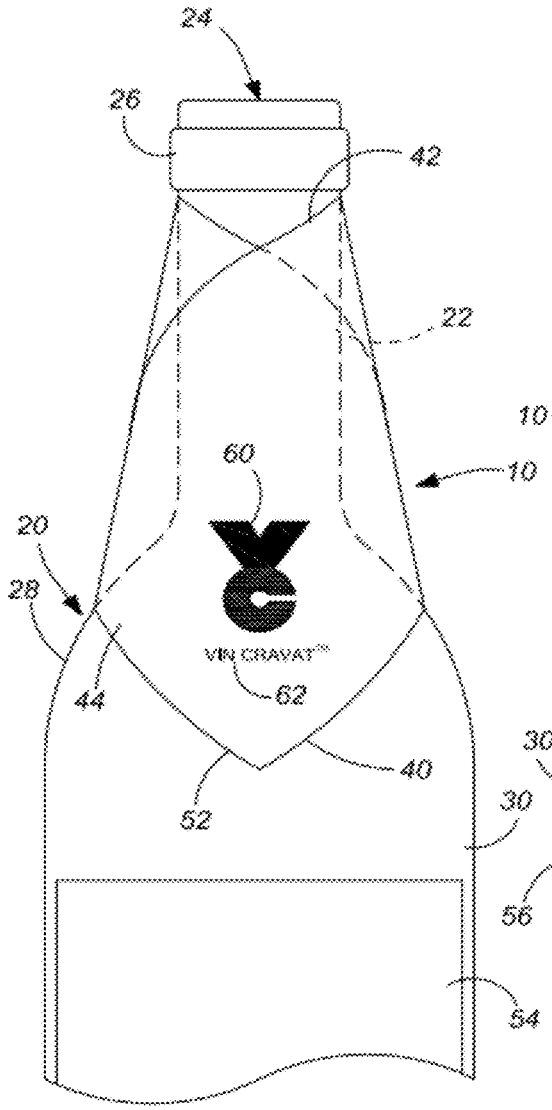
Figure 2:
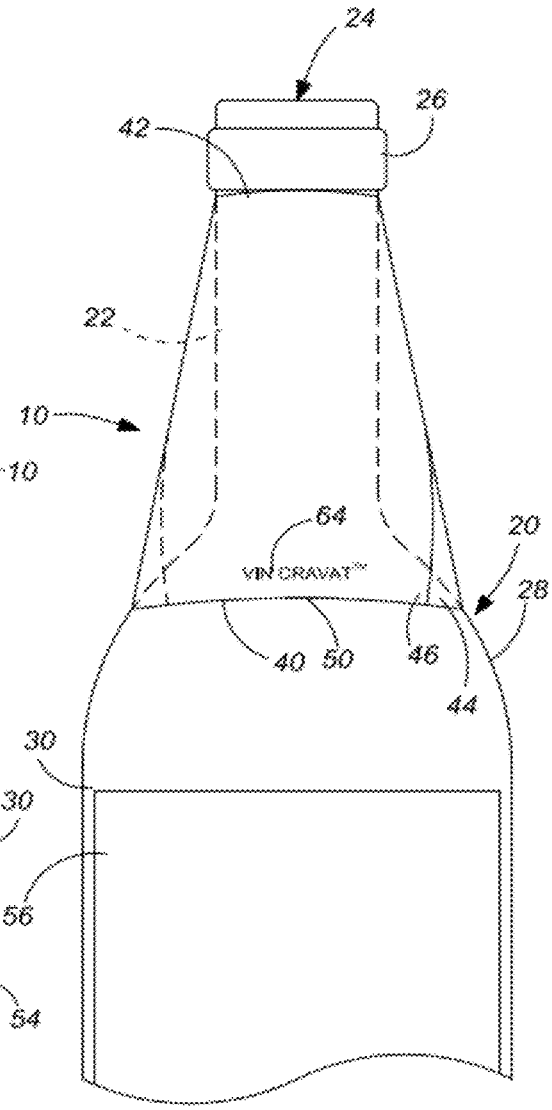
FIG. 2 illustrates a rear elevational view of the collar on the bottle.
Figure 3:
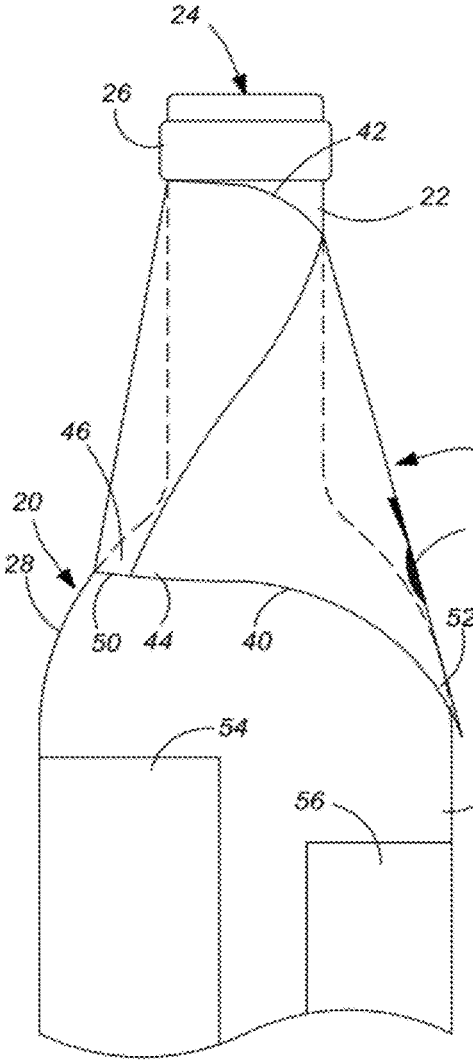
FIG. 3 illustrates a left side elevational view of the collar on the bottle.
Figure 4:
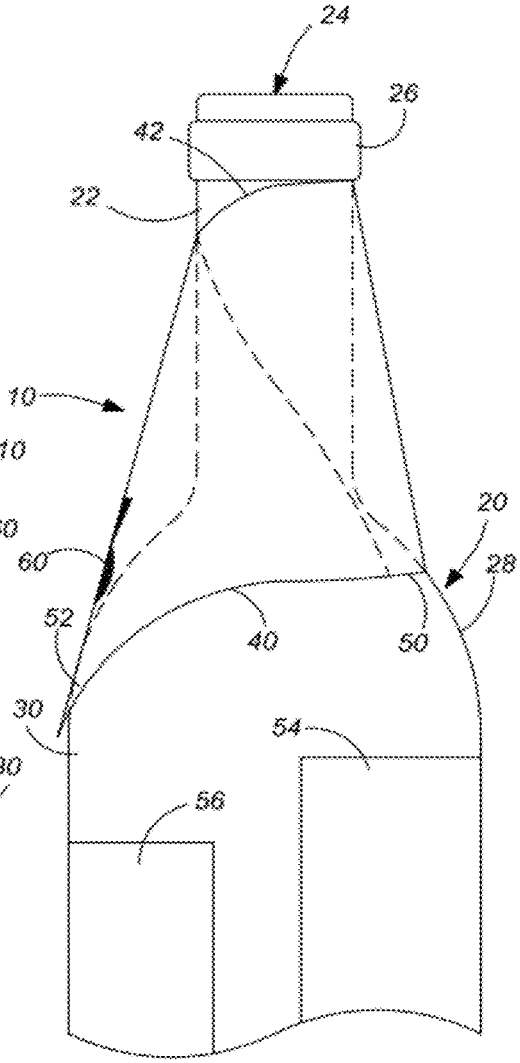
FIG. 4 illustrates a right side elevational view of the collar on the bottle.
Figure 5:
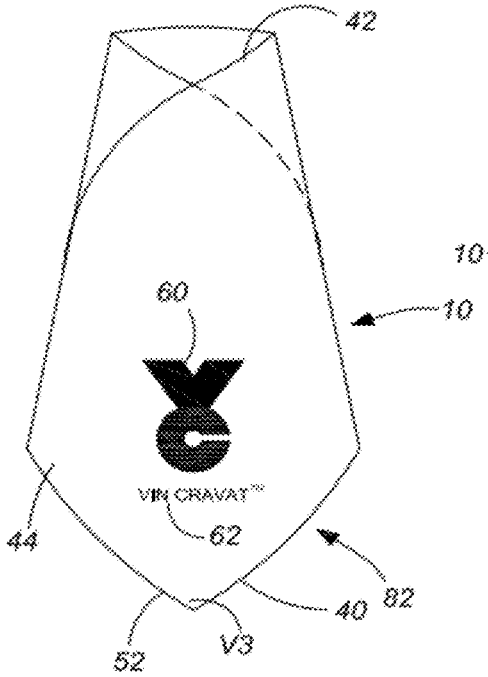
FIG. 5 illustrates a front elevational view of the collar when not on the bottle.
Figure 6:
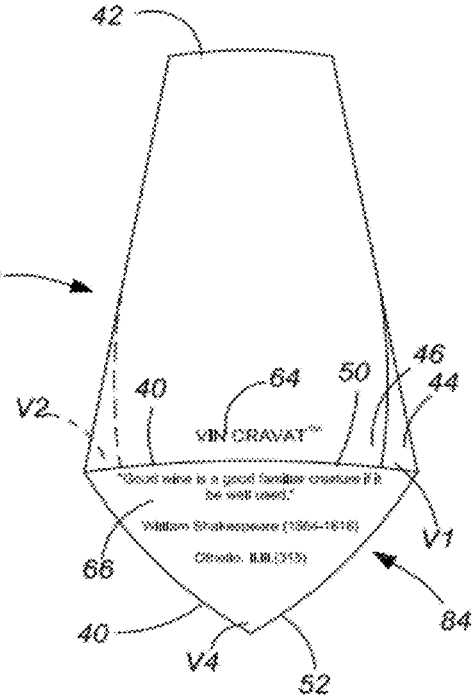
FIG. 6 illustrates a rear elevational view of the collar when not on the bottle.
Figure 7:
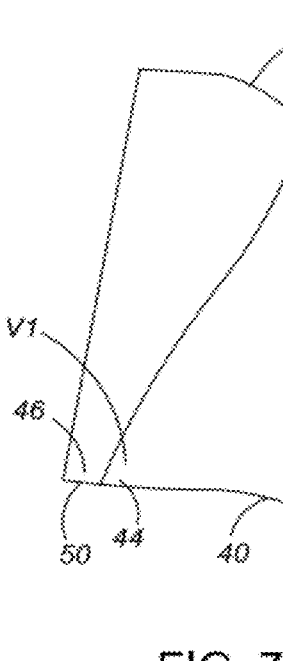
FIG. 7 illustrates a left side elevational view of the collar when not on the bottle.
Figure 8:
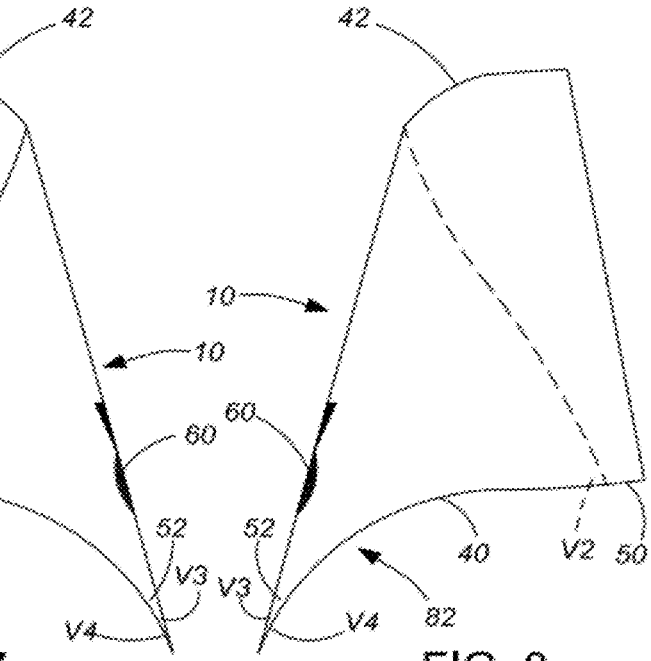
FIG. 8 illustrates a right side elevational view of the collar when not on the bottle.

FIG. 1 illustrates a front elevational view of a drip-stop collar 10 positioned on the neck 22 of a bottle 20, such as, for example, a bottle of wine, a bottle of liquor, or the like. FIG. 2 illustrates a rear elevational view of the collar on the bottle. FIG. 3 illustrates a left side elevational view of the collar on the bottle. FIG. 4 illustrates a right side elevational view of the collar on the bottle. FIG. 5 illustrates a front elevational view of the collar when not on the bottle. FIG. 6 illustrates a rear elevational view of the collar when not on the bottle. FIG. 7 illustrates a left side elevational view of the collar when not on the bottle. FIG. 8 illustrates a right side elevational view of the collar when not on the bottle.

As shown in FIGS. 1-4, the bottle 20 includes an upper mouth 24 and a flange (ridge) 26 just below the mouth. The neck 22 of the bottle slopes outwardly below the flange and intersects a shoulder 28 that transitions from the neck to the generally cylindrical main body 30 of the bottle.

As illustrated in FIGS. 1-8, the collar 10 includes a lower peripheral edge 40 and an upper peripheral edge 42. The two peripheral edges are formed by overlapping the edges of an initially flat panel of a flexible material in a manner to be described below so that a first end portion 44 of the collar overlaps a second end portion 46 as shown in FIG. 2.

When the collar 10 is positioned on the bottle 20 as shown in FIGS. 1-4, the collar slips over the flange 26 and is moved down the neck 22 until a rear portion 50 of the lower peripheral edge 40 of the collar rests on the shoulder 28 at the rear of the bottle (FIG. 2). A front portion 52 of the lower peripheral edge of the collar extends downwardly over the shoulder of the bottle and may overlap an upper portion of the main body 30 of the bottle.

As illustrated in FIG. 1, for example, the shape of the front portion 52 of the lower peripheral edge 40 of the collar 10 coupled with the overlapping first end portion 44 and second end portion 46 of the upper peripheral edge 42 of the collar has an appearance similar to a cravat. Preferably, the "pointed" shape of the front portion is positioned on the neck 22 of the bottle 20 so that the point directs a viewer's attention to a front label 54 of the bottle. The bottle may also have a rear label 56.

In particularly advantageous embodiments of the collar 10, the exposed outer surface of the collar is decorated. For example, in the illustrated embodiment, the front of the collar (FIGS. 1 and 5) is labeled with a logo 60 and a trademark 62 of the manufacturer of the collar. The rear of the collar (FIGS. 2 and 6) is also labeled with a representation 64 of the name or trademark of the manufacturer. In alternative embodiments (not shown), the collar may be adorned (e.g., printed) with a pattern to endow the collar with the appearance of a cloth cravat. In further alternative embodiments, the collar may be adorned with a seasonal pattern, a holiday pattern, or celebration (birthday, wedding, anniversary, retirement, or the like) so that the pattern of the collar is matched to the occasion for which the bottle is being presented as a gift. A restaurant or a retailer may also have collars adorned with information representing where the bottle was purchased.

In addition to the adornment on the outer surface, a portion of the inner surface of the collar 10 may also be labeled with other suitable information 66 as shown, for example, in FIG. 6. The portion of the inner surface behind the "pointed" front portion 52 of the lower peripheral edge 40 of the collar is a particularly advantageous location for the information since that portion of the surface is exposed when the liquid level is lowered in a clear bottle 20 and when the collar is removed from a bottle. The information may comprise one or more of many types of information. For example, FIG. 6 illustrates a famous quote about wine. Other types of information include, for example, comments from the wine master, recommended recipes or foods to match with the wine or liquor, a retailer coupon or the like. The information may also be an indication as a space for recording information about the wine (such as date opened or tasting comments), the occasion (e.g., birthday, anniversary, holiday, or the like).

Figure 9:
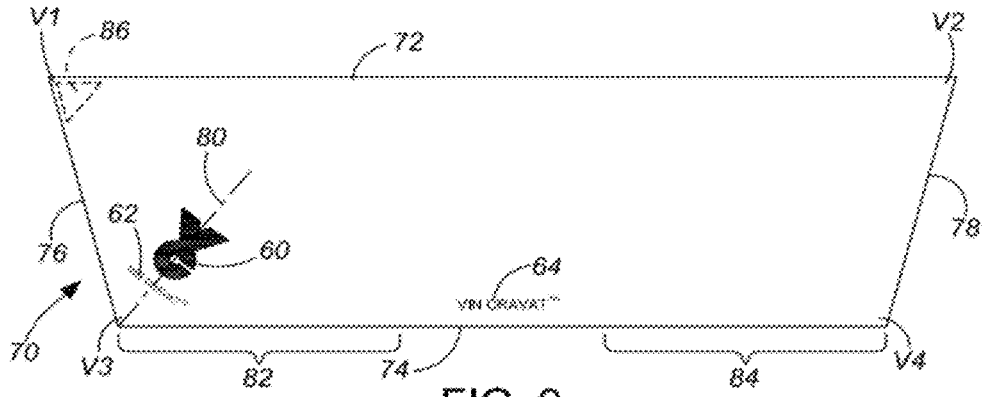
FIG. 9 illustrates the drip-stop collar of FIGS. 1-8 in an original flat material form prior to being formed into the generally conical form illustrated in FIGS. 1-8, the form of FIG. 9 having an adhesive on the inside surface behind a first vertex.

FIG. 9 illustrates the drip-stop collar 10 in an original flat material form 70 prior to being formed into the generally conical form illustrated in FIGS. 1-8. The original form comprises a suitable flexible material, such as, for example, cloth, absorbent paper, or the like. The original form has a generally trapezoidal shape with an exposed decorative outer surface and an opposing inner surface (not shown in FIG. 9). Preferably, the original shape of the outer surface is an isosceles trapezoid as shown, which comprises a longer upper edge 72 and a shorter lower edge 74. The longer and shorter edges are parallel. The two parallel edges are interconnected by a left sloped edge 76 and a right sloped edge 78. The left sloped edge and the right sloped edge form angles with respect to the two parallel edges and are substantially symmetrical about a midpoint of the outer surface of the form. The left sloped edge forms a first vertex V1 with the longer (upper) edge. The right sloped edge forms a second vertex V2 with the longer edge. The left sloped edge forms a third vertex V3 with the shorter (lower) edge. The right edge forms a fourth vertex V4 with the shorter edge.

In the illustrated embodiment of the material form 70 shown in FIG. 9, the longer edge 72 has a length of approximately 24.3 centimeters, and the shorter edge 74 has a length of approximately 20.5 centimeters. The left sloped edge 76 and the right sloped edge 78 have lengths of approximately 7.5 centimeters. The upper vertices V1 and V2 form acute angles of approximately 76 degrees. The lower vertices V3 and V4 form angles of approximately 104 degrees.

In FIG. 9, the exposed surface of the form 70 is shown with the adornment illustrated in FIGS. 1 and 5. As shown, the manufacturer's logo 60 and trademark 62 are shown positioned proximate to the third vertex V3 between the left sloped edge 76 and the shorter edge 74. Instead of being oriented vertically, the logo and trademark are positioned along an axis 80 that bisects the third vertex V3 so that the logo and vertex will be oriented vertically when the form is formed into the generally conical collar 10 shown in FIGS. 1-8. The representation 64 that will be on the rear portion of the collar is shown along the lower edge at approximately the midpoint of the shorter edge.

In FIG. 9, a leftmost portion 82 of the shorter edge 74 will become an overlapping portion of the shorter edge when the collar 10 is formed into the generally conical shape in the manner described below. A rightmost portion 84 of the shorter edge will become an overlapped portion of the shorter edge.

In order to maintain the truncated, generally conical shape of the drip-collar 10, a fastener secures the overlapping first vertex V1 to the underlying portion of the form 70. For example, in the embodiment of FIG. 9, the fastener comprises an adhesive. In particular, an unexposed inside surface of the form 70 includes a small amount of adhesive 86 beneath the first vertex V1 as represented by a dashed triangle. The adhesive may be applied when the form is formed into the collar 10 or the adhesive may be pre-applied and temporarily covered with a protective cover or liner. The protective cover or liner is removed when the collar is formed into the conical shape with the vertices properly positioned as described below.

As shown in FIGS. 5 and 7, for example, the collar 10 is created from the form 70 by curling the form so that the third vertex V3 is positioned over the fourth vertex V4 with the third vertex V3 completely covering the fourth vertex V4. In particular, when the two vertices are properly aligned, the left sloped edge 76 is aligned with the overlapped rightmost portion 84 of the shorter edge 74 and extends up and to the left from the overlapping vertices as shown in FIG. 5. Similarly, the overlapping leftmost portion 82 of the shorter edge is aligned with and covers the right sloped edge 78. The combination of the overlapping vertices and the overlapping edges enables the collar to be readily assembled into the proper generally conical shape with the "point" of the cravat appearing as a single piece. With the edges and vertices aligned and held firmly in place, the adhesive 86 is applied to the inside surface of the first vertex V1. Alternatively, the protective cover or liner is removed from pre-applied adhesive at the same location. Pressure is applied across the first vertex V1 and the underlying location on the lower edge for a sufficient time to allow the adhesive to set and secure the first vertex V1 to the shorter edge. The resulting generally conical shape is maintained with only the adhesive at this single flex point.

Because the conical shape of the collar 10 is maintained by only the adhesive 86 at the single location, the opening at the upper peripheral edge 42 is free to move by a sufficient amount so that the opening is able to expand from a size smaller than the flange 26 of the bottle 20 to a size sufficiently large to enable the flange to pass through the opening when sufficient pressure is applied to the collar. After the flange passes through the opening, the resilience of the material forming the collar causes the opening to return to the original size so that the collar cannot move over the flange in the absence of deliberately applied pressure to remove the collar. In the unexpanded state, the upper peripheral edge forms a tight seal around the neck 22 of the bottle to cause any residual drips from the mouth or flange of the bottle to strike the outer surface of the collar and be absorbed by the collar rather than dribbling down the length of the bottle.

Figure 10:
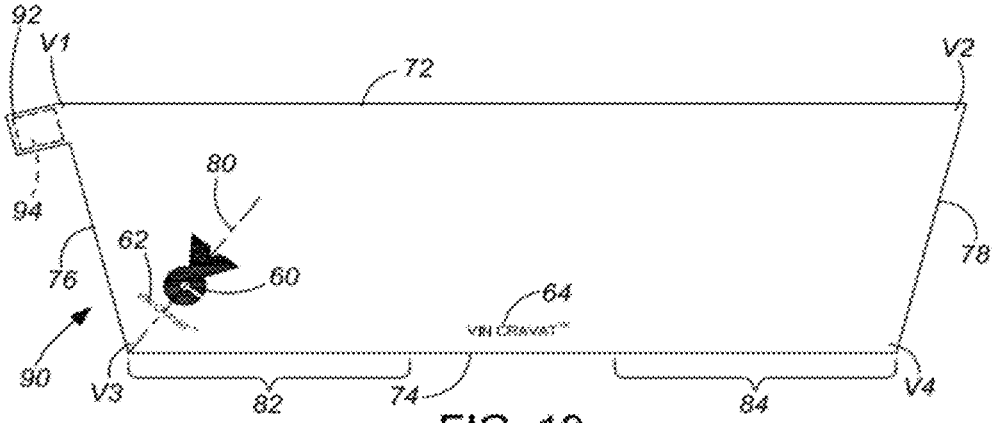
FIG. 10 illustrates an alternative embodiment of the flat material form of FIG. 9 with a tab that extends from the first vertex, the tab having an adhesive on an inside surface.

FIG. 10 illustrates an alternative embodiment of a form 90 for the collar 10. The form in FIG. 10 has a shape generally the same as the form 70 except that the single fastener comprises a tab 92 that extends from the first vertex V1. As illustrated by dashed lines, an adhesive 94 is positioned on the inside surface of the tab, either when the form is being shaped into the collar or in advance and covered with a protective cover or liner as discussed above. After aligning the third vertex V3 with the fourth vertex V4, aligning the left portion 82 of the shorter edge 74 with the left sloped edge 76 and aligning the right portion 84 of the shorter edge with the right sloped edge 78 as described above, the tab is bent around the shorter edge, and the adhesive is allowed to set to secure the tab to the inside surface of the form.

Figure 11:
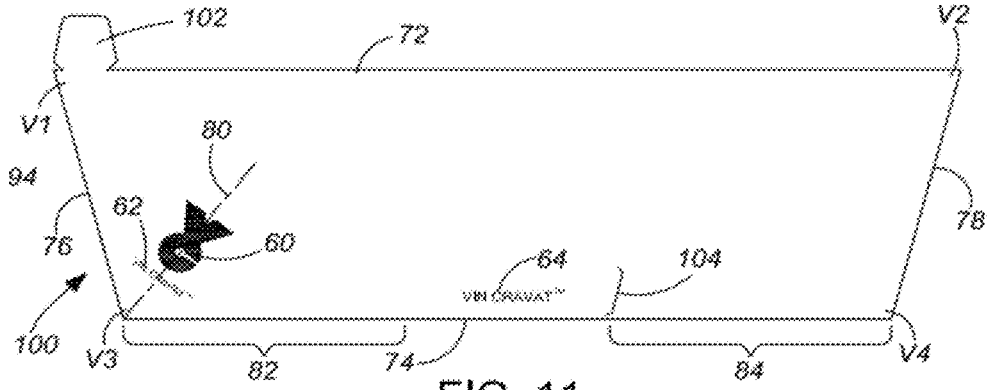
FIG. 11 illustrates a further embodiment of the form of FIG. 9 that includes a tab that extends from the upper edge, the tab positioned to engage a slot proximate to the lower edge when the third and fourth vertices are aligned.

FIG. 11 illustrates a further embodiment of a form 100 wherein the single fastener comprises a tab 102 that extends from the longer edge 72. A corresponding slot 104 is formed proximate to the boundary of the overlapped rightmost portion 84 of the shorter edge 74 so that when the collar 10 is formed as described above, the tab fits into the slot and secures the collar into the desired form.

In addition to the foregoing embodiments wherein the single fastener comprises adhesives and tabs, the collar 10 may also be bonded at a single flex (pivot) point by using alternative fasteners, such as, for example, a staple, a rivet, or a stitch formed with thread.

As discussed above, logos and other information can be added to the form 70, 90 or 100 from which the collar 10 is created. The logos and other information, are advantageously added to the form using a variety of methods such as, for example, printing, embossing, de-bossing, foiling, screen printing, handwriting, embroidery, heat transfer, dye sublimation, or other suitable methods. A name, a logo or both can also be affixed to the device with the application of a separate sticker or label so that customized information can be added to a generically decorated collar.

Figure 12:
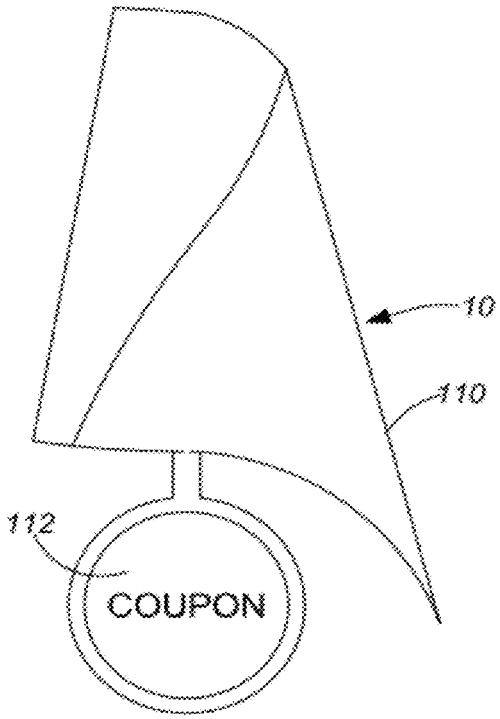
FIG. 12 illustrates a drip-stop collar having an information piece attached to the left edge of a form so that the piece descends below the collar on the left side.
Figure 13:
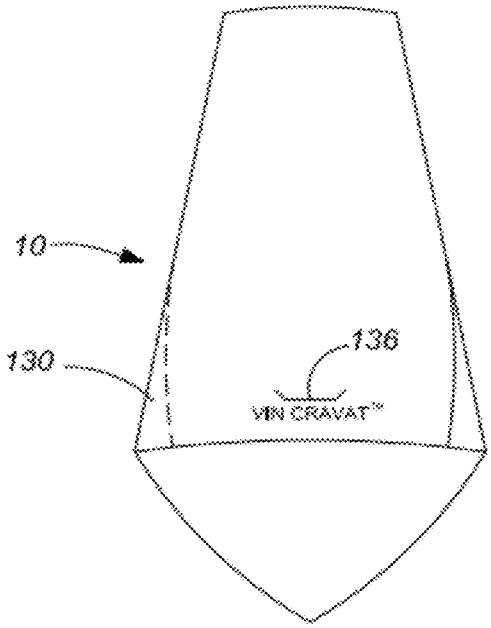
FIG. 13 illustrates a drip-stop collar having an information piece extending from the lower edge of a form so that the information piece descends from the rear of the completed collar, the information piece.
Figure 13:
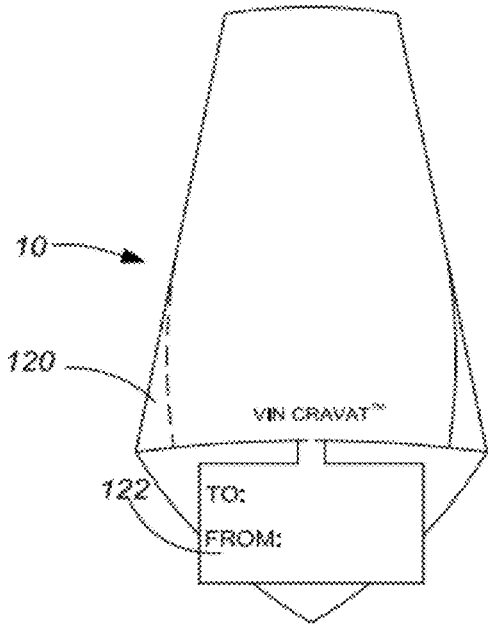
Figure 14:
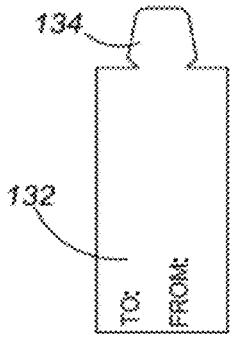
FIG. 14 illustrates a drip-stop collar having an information piece extending from the rear of a form proximate to the lower edge, the information piece including a tab that engages a slot proximate to the middle of the lower edge of the form.

As illustrated in FIGS. 12, 13 and 14, the collar 10 may also include an additional piece that can be separated from the collar. For example, FIG. 12 illustrates an information piece 112 attached to the left edge of a form 110 so that the piece descends below the collar on the left side when the collar is created. The information piece may comprise a coupon or other information. In FIG. 12, the information piece is created as part of the original form with a narrow portion of the information piece perforated for easy removal from the form. The information piece may also be removably secured to the form with a flex (removable) adhesive.

In FIG. 13, an information piece 122 extends from the lower edge of a form 120 so that the information piece descends from the rear of the completed collar. The information piece in FIG. 13 is also advantageously perforated at a narrow portion for easy removal. The information piece in FIG. 11 or the information piece in FIG. 12 allows the vineyard or retailer to add additional information to the bottle such as a coupon, recipes, and/or any awards the wine has won.

In FIG. 14, an information piece 132 extends from the rear of a form 130 proximate to the lower edge. Instead of being part of the form, the information piece includes a tab 134 that engages a slot 136 proximate to the middle of the lower edge of the form. The embodiment of FIG. 14 advantageously allows a purchaser to add information to the information piece before attaching the information piece to the collar.

As various changes could be made in the above constructions without departing from the scope of the invention, it is intended that all the matter contained in the above description or shown in the accompanying drawings shall be interpreted as illustrative and not in a limiting sense.

What is claimed is:

1. A drip-collar for a bottle comprising:

a sheet of flexible, absorbent material having an isosceles trapezoidal shape, the trapezoidal shape comprising:

a longer edge and a shorter edge, the longer edge and the shorter edge being mutually parallel when the trapezoidal shape is flat; and a first sloped edge and a second sloped edge between the longer edge and the shorter edge, the first sloped edge forming a first vertex with the longer edge, the second sloped edge forming a second vertex with the longer edge, the first vertex and the second vertex having substantially equal acute angles, the first sloped edge forming a third vertex with the shorter edge, the second sloped edge forming a fourth vertex with the shorter edge, the third vertex and the fourth vertex having substantially equal obtuse angles;

and a fastener positioned to secure the first vertex to a location on the shorter edge to form the sheet into a truncated, generally conical form with the third vertex positioned over the fourth vertex, with the first sloped edge aligned with a first portion of the shorter edge proximate to the fourth vertex, and with the second sloped edge aligned with a second portion of the shorter edge proximate to the third vertex.

2. The drip-collar as defined in claim 1, wherein the fastener comprises an adhesive on an inner surface of the first vertex that secures the inner surface of the first vertex to an outer surface of the sheet proximate to the shorter edge.

3. The drip-collar as defined in claim 1, wherein the fastener comprises a tab that extends from the first sloped edge proximate to the first vertex, the tab being foldable about the shorter edge to position an inner surface of the tab against an inner surface of the sheet proximate to the shorter edge, the inner surface of the tab having an adhesive that secures the inner surface of the tab to the inner surface of the sheet proximate to the shorter edge.

4. The drip-collar as defined in claim 1, wherein the fastener comprises a tab that extends from the longer edge proximate to the first vertex and a slot formed through the sheet at a location proximate to the position of the first vertex when the sheet is formed in the conical shape, the tab being positionable through the slot to retain the sheet in the conical shape.

5. The drip-collar as defined in claim 1, wherein the drip-collar has the appearance of a cravat when the drip-collar is positioned over the neck of a bottle with a lower perimeter of the drip-collar resting on a shoulder between the neck and a main body of the bottle.

6. The drip-collar as defined in claim 1, wherein the truncated, generally conical shape of the drip-collar comprises:

a lower peripheral opening formed by the shorter edge, the lower peripheral opening sized to allow the drip-collar to rest on the shoulder of a bottle; and an upper opening formed by overlapping portions of the longer edge, the upper opening sized to fit the neck of a bottle and being sized to be less than the size of a flange around the neck of the bottle, the upper opening being spaced a sufficient distance away from the fastener to enable the upper opening to flex with respect to the fastener and temporarily expand to allow the flange to pass through the upper opening.

7. A method of forming a decorative drip-collar for a bottle having a main body, a neck with an upper opening, a flange on the neck below the opening and a shoulder forming a transition between the main body and the neck, the method comprising:

providing a flat sheet of flexible material having an outer surface and an inner surface, the outer surface shaped as an isosceles trapezoid having longer and shorter edges that are mutually parallel and having first and second sloped edges, the first sloped edge forming a first vertex at an acute angle with the longer edge, the second sloped edge forming a second vertex at the acute angle with the longer edge, the first sloped edge forming a third vertex at an obtuse angle with the shorter edge, the second sloped edge forming a fourth vertex at the obtuse angle with the shorter edge;

curling the sheet of flexible material into a truncated conical shape to position the third vertex over the fourth vertex, to position the first sloped edge over and in alignment with a portion of the shorter edge proximate to the fourth vertex, and to position a portion of the shorter edge proximate to the third vertex over and in alignment with the second sloped edge; and securing a first portion of the sheet of flexible material proximate to the first vertex to an underlying second portion of the sheet proximate to the shorter edge to retain the sheet in the truncated conical shape.

8. The method as defined in claim 7, wherein the first portion of the sheet of flexible material is secured to the second portion of the sheet using an adhesive applied between the inner surface of the first portion of the sheet and the outer surface of the second portion of the sheet.

9. The method as defined in claim 7, wherein the first portion of the sheet of flexible material is secured to the second portion of the sheet using an adhesive applied to a tab extending from the first sloped edge, the tab folded about the lower edge to secure the tab to the inner surface of the sheet proximate to the first sloped edge.

10. The method as defined in claim 7, wherein the first portion of the sheet of flexible material is secured to the second portion of the sheet using a tab that extends from the longer edge, the tab sized to engage a slot formed in the sheet at a location adjacent to the position of the slot when the sheet is formed into the truncated conical shape with the third and fourth vertices mutually aligned.

11. A method of reducing dripping of liquid from a bottle having a main body, a neck with an upper opening, a flange on the neck below the opening and a shoulder forming a transition between the main body and the neck, the method comprising:

forming a drip-collar having a truncated, generally conical shape from a sheet of flexible, absorbent material having an initial isosceles trapezoidal shape, the trapezoidal shape having a longer edge and a shorter edge with the shorter edge parallel to the longer edge, and having a first sloped edge and a second sloped edge, the truncated, generally conical shape having a lower opening defined by a lower peripheral edge formed by the shorter edge of the trapezoidal shape and having an upper opening defined by an upper peripheral edge formed by the longer edge of the trapezoidal shape, the truncated, generally conical shape formed by aligning at least one of the first and second sloped edges with a portion of the shorter edge of the trapezoidal shape, wherein the lengths of the longer edge, the shorter edge and the first and second sloped edges are selected such that the upper opening has a static size smaller than the flange on the neck of the bottle;

securing the sheet of flexible, absorbent material into the truncated, generally conical shape at a single location along the lower peripheral edge of the generally conical shape; and positioning the drip-collar over the neck of the bottle, the upper opening being sufficiently displaced from the single location along the lower peripheral edge to enable the upper opening to temporarily expand from the static size to a size sufficiently large to allow the flange of the bottle to pass through the upper opening, the upper opening returning to a size that causes the upper opening to fit closely around the neck of the bottle below the flange.

12. The method as defined in claim 11, wherein a portion of the lower peripheral edge of the truncated, generally conical shape is formed by overlapping vertices of the trapezoidal-shaped material at the intersections of the shorter edge and the first and second sloped edges, the vertices having obtuse angles such that the lower peripheral edge has the appearance of a cravat.

13. A drip-collar for a bottle comprising:

a sheet of flexible, absorbent material having an isosceles trapezoidal shape, the trapezoidal shape comprising:

a longer edge and a shorter edge, the longer edge and the shorter edge being mutually parallel when the trapezoidal shape is flat; and a first sloped edge and a second sloped edge between the longer edge and the shorter edge, the first sloped edge forming a first vertex with the longer edge, the second sloped edge forming a second vertex with the longer edge, the first vertex and the second vertex having substantially equal acute angles, the first sloped edge forming a third vertex with the shorter edge, the second sloped edge forming a fourth vertex with the shorter edge, the third vertex and the fourth vertex having substantially equal obtuse angles;

and a fastener positioned to secure the first vertex to a location on the shorter edge to form the sheet into a truncated, generally conical form with the third vertex positioned over the fourth vertex, with the first sloped edge aligned with a first portion of the shorter edge proximate to the fourth vertex, and with the second sloped edge aligned with a second portion of the shorter edge proximate to the third vertex, wherein:

the sheet includes a slot formed close to the short edge of the sheet; and an information piece having a tab is removably attached to the drip-collar by inserting the tab of the information piece into the slot of the sheet.

14. A method of forming a decorative drip-collar for a bottle having a main body, a neck with an upper opening, a flange on the neck below the opening and a shoulder forming a transition between the main body and the neck, the method comprising:

providing a flat sheet of flexible material having an outer surface and an inner surface, the outer surface shaped as an isosceles trapezoid having longer and shorter edges that are mutually parallel and having first and second sloped edges, the first sloped edge forming a first vertex at an acute angle with the longer edge, the second sloped edge forming a second vertex at the acute angle with the longer edge, the first sloped edge forming a third vertex at an obtuse angle with the shorter edge, the second sloped edge forming a fourth vertex at the obtuse angle with the shorter edge;

curling the sheet of flexible material into a truncated conical shape to position the third vertex over the second vertex, to position the first sloped edge over and in alignment with a portion of the shorter edge proximate to the fourth vertex, and to position a portion of the shorter edge proximate to the third vertex over and in alignment with the second sloped edge;

securing a first portion of the sheet of flexible material proximate to the first vertex to an underlying second portion of the sheet proximate to the lower edge to retain the sheet in the truncated conical shape;

forming a slot in the sheet close to the short edge of the sheet; and removably attaching an information piece having a tab to the drip-collar by inserting the tab of the information piece into the slot in the sheet.

* * * * *